US007967959B2

(12) United States Patent
Howard et al.

(10) Patent No.: US 7,967,959 B2
(45) Date of Patent: Jun. 28, 2011

(54) CATHODIC PROTECTION METHOD AND APPARATUS

(75) Inventors: Donald Paul Howard, Houston, TX (US); Harris A. Reynolds, Jr., Houston, TX (US)

(73) Assignee: Diamond Offshore Drilling, Inc., Houston, TX (US)

( * ) Notice: Subject to any disclaimer, the term of this patent is extended or adjusted under 35 U.S.C. 154(b) by 267 days.

(21) Appl. No.: 12/429,969

(22) Filed: Apr. 24, 2009

(65) Prior Publication Data

US 2010/0270169 A1 Oct. 28, 2010

(51) Int. Cl.
*C23F 13/04* (2006.01)

(52) U.S. Cl. ..... 204/196.18; 204/196.23; 204/196.24; 204/196.25; 204/196.37; 204/404; 205/724; 205/730; 205/740; 205/775.5

(58) Field of Classification Search ..... 204/196.18, 204/196.23–196.25, 196.37, 404; 205/724, 205/730, 740, 775.5
See application file for complete search history.

(56) References Cited

U.S. PATENT DOCUMENTS

| | | | | |
|---|---|---|---|---|
| 4,175,021 | A * | 11/1979 | Tatum et al. | 204/196.36 |
| 4,409,081 | A * | 10/1983 | Terrase | 204/196.18 |
| 4,484,838 | A * | 11/1984 | Stevens | 405/191 |
| 4,496,013 | A * | 1/1985 | Serpa | 175/374 |
| 6,331,242 | B1 * | 12/2001 | Horton | 205/724 |
| 7,211,173 | B1 * | 5/2007 | Staerzl et al. | 204/196.37 |
| 7,402,233 | B1 * | 7/2008 | Morgan | 205/730 |
| 2010/0038261 | A1 * | 2/2010 | Bennett | 205/766 |

FOREIGN PATENT DOCUMENTS

IT EP0615002 * 9/1994

* cited by examiner

*Primary Examiner* — Bruce F Bell
(74) *Attorney, Agent, or Firm* — Osha Liang LLP

(57) ABSTRACT

A cathodic protection system for use in an electrolyte includes a protected structure to be at least partially immersed in the electrolyte, at least one sacrificial anode to be at least partially immersed in the electrolyte and electrically connected to the protected structure, and a substantially impermeable barrier disposed between the at least one sacrificial anode and the electrolyte.

18 Claims, 5 Drawing Sheets

CATHODIC PROTECTION METHOD AND APPARATUS

BACKGROUND

1. Field of the Disclosure

Embodiments disclosed herein relate generally to a cathodic protection apparatus and method. In particular, embodiments disclosed herein relate to passive cathodic systems.

2. Background Art

Cathodic protection is an electrical method for mitigating corrosion of metallic structures, particularly metallic structures immersed in electrolytes, such as seawater. Marine equipment and structures, particularly those used for offshore oil and gas exploration and production, have long been protected by cathodic protection ("CP") systems, including both active ("impressed current") systems using an electrical current source, and so-called passive systems, which typically employ sacrificial anodes of metals which are less noble than the protected equipment and structures. So-called "hybrid" cathodic protection systems may employ elements of both active and passive systems.

Marine equipment and structures that are deployed at or near the seabed, such as subsea blowout preventers ("BOPs"), drilling and production riser pipes, production trees, valves, manifolds, templates and associated piping and pipelines, may typically be protected by passive cathodic protection systems, mainly because of the difficulty and expense of maintaining an impressed current on equipment that may be a mile or more below the ocean surface.

For passive cathodic protection systems, the offshore oil and gas industry has, over time, effectively standardized on sacrificial anodes made from aluminum-zinc-indium alloys, which in seawater may produce a cathodic potential on the order of −1.0 volts (commonly expressed as −1000 millivolts, or mV) referenced to a standard silver/silver chloride (Ag/AgCl) electrode. Anodes of aluminum-zinc-indium alloys typically provide a good balance of cathodic potential, current, economy, and long life in seawater. In addition, anodes of aluminum-zinc-indium alloys have good structural strength in use, relatively uniform consumption across the surface of the anode, and good shelf life in air.

However, as protective coatings have steadily improved, as oil and gas exploration and production has gone into deeper water depths, and as equipment has been constructed of higher-strength steels to meet higher pressure requirements, it has been discovered that standard offshore oilfield passive cathodic protection systems, including those using aluminum-zinc-indium sacrificial anodes, may have several issues. For example, it may be difficult to accurately predict the exact net potential of a passive CP system in marine service, especially proximate the seabed; it requires, for example, a complete understanding of the properties of the electrolyte (seawater) in the environs of the system, the total cathodic area of the protected equipment or structure, and the properties of any coatings on the protected structure.

In addition, in a related issue, it may be difficult to predict the current density that will be achieved by a marine CP system, especially over time as, for example, applied protective coatings or a calcareous layer wear away, or, in the case of mobile offshore drilling units (or MODUs, such as jack-ups, drillships and semi-submersibles) as the marine conditions (such as water depth, water temperature, current velocity, etc.) change significantly from one drilling location to another half a world away. For example, if significant flaws develop in a coating on cathodically protected equipment, a CP system may operate at a lower current density than anticipated. Alternatively, if the paint on a protected structure is thicker or of higher electrical resistance than expected, a CP system may exhibit a higher current density than contemplated, and consequently a higher cathodic potential than desired, which may increase the possibility of deleterious hydrogen embrittlement of the protected structure, particularly for equipment made from high strengths steels (for example, with yield strengths above 700 MPa or about 100,000 psi).

Guidelines for the required current density induced by a passive cathodic protection system typically include a "safety factor" of at least 25 percent. Such a "safety factor" may add considerable weight and expense to the protected structure; or the excess "safety factor" anodes will be sacrificed along with all the other anodes, and will not be available later to, for example, extend the life of the cathodic protection system. In addition, an optimum marine cathodic protection system may require a "potential profile" over time; for example, an initial large negative potential, on the order of −900 mV, to quickly build-up a dense layer of calcareous deposits on the protected structure, and then a much smaller negative potential for "maintenance" of the cathodic protection. While such a "potential profile" may be easily and accurately achieved with an impressed current system simply by adjusting the voltage of the active current source over time, it is extremely difficult, using prior art devices or methods, to accurately adjust the potential of a passive CP system, particularly at or near the seabed.

One prior art approach to controlling cathodic potential of a passive CP system, especially to prevent hydrogen embrittlement, has been to change the composition of the sacrificial anodes to reduce their open-circuit potentials. For example, while commonly used aluminum-zinc-indium anodes may typically have an open-circuit potential of about −1000 to −1050 millivolts, so-called "low voltage" anodes (such as, for example, aluminum-gallium anodes commercially available from, for example, Norton Corrosion Limited of Woodinville, Wash.) may have an open-circuit potential of about −800 millivolts; such low-voltage anodes are generally not capable of polarizing a structure to potentials at which hydrogen embrittlement is a significant risk. This "low voltage" approach has the disadvantages that the cathodic potentials and current are not adjustable in situ, that it requires specialized anodes specifically for areas of protected structures which may be at high risk of hydrogen embrittlement (as opposed to, for example, adjusting the potential of a standard anode in the same service), and that the low voltage anodes required may not be sufficiently mechanically strong in service or have adequate shelf life in air.

Another prior art approach to limiting cathodic potentials in order to avoid potential hydrogen embrittlement has been to use voltage-limiting diodes in series electrically between the sacrificial anode and the protected structure. This approach has the advantage that standard marine aluminum-zinc-indium anodes may be used, but it has several disadvantages in service, including (a) the sacrificial anode must be isolated electrically from the protected structure, (b) the diodes constitute an additional potential failure point in the system, and (c) the cathodic potential in the protected structure may not be adjusted, (d) the break-down voltage of the diodes may not be exactly correct, or it may be quite "sharp" or "abrupt" where, in a CP system, a more gradual breakdown may be desired, and finally (e) such a system may be highly inefficient, as at least some exposed anodic area may not be electrically connected to the protected structure (that is, anodes may be corroding-away in an open-circuit condition without providing any cathodic protection).

One passive sacrificial anode of the prior art, as taught in European Patent Application EP 0615002A1 ("the EP-002 application") from AGIP S.p.A. of Milano, Italy, is shown in FIG. 1. It is designed to apply a "potential profile" over time by the expedient of a composite anode structure using two anodic materials; conductive carrier means 1 has an overmolded inner core 2 of anodic material with higher electronegativity than the structure to be protected (that is, a relatively less noble material, such as an aluminum alloy), with an outer coating 3 of anodic material with a still higher electronegativity than inner core 2 (that is, an even less noble material, such as a magnesium alloy).

Initially, the outer coating 3 of, say, magnesium alloy will induce a relatively high negative cathodic potential, which has been shown experimentally to favor the creation of a dense base layer of protective calcareous deposits on the protected structures and equipment. Subsequently, after the outer coating 3 is sacrificially consumed, a relatively lower negative cathodic potential will be induced by the inner core 2 of, say, aluminum alloy.

As will be clear to those with ordinary skill in the art, this approach requires careful selection of such variables as the anodic materials, placement of the sacrificial anodes on the protected structure, and the thickness of the outer anode layer, in order to achieve the desired potential profile. Further, it is not contemplated that either the cathodic potential or the current density created by this composite anode be adjustable in situ. In addition, the present inventors of the current disclosure believe that it would be difficult to achieve a uniform and structurally and electrically sound interface between the two anodic materials of this design. The inventors of the current disclosure believe that because of these and other limitations of this design, the anodes taught in the EP-002 application are not commercial available.

A prior art means of continuously providing sacrificial anode material to a protected structure is taught in U.S. Pat. No. 4,549,948 (the '948 patent) issued to Peterson, et al, is shown is FIG. 2. Note that a similar system is taught in related U.S. Pat. No. 4,318,787, issued to the same inventors. FIG. 2 shows a cross-sectional view of a container 12 attached to a support member 11 of an offshore platform (not shown). The sacrificial anode may be replenished continuously or periodically by feeding the anode in particulate form to the container 12, which is located under the surface of the water and electrically connected to the structure (offshore platform) to be protected. As shown, the container 12 has perforations 23 to allow the water to enter it. It is attached to support member 11 by a support bracket 15 and the lower portion of the container is an extrusion die 24 made of steel. A thixotropic mixture of a thixotropic carrier material and particulate anodic material is pumped from the surface through conduit 13 into extrusion die 24; under pressure from the surface, the thixotropic mixture extrudes from extrusion die 24 into elongated shape 26 within subsea container 12 forming a sacrificial anode in contact with seawater (the electrolyte) passing through perforations 23. A separate electrical connection 27 is provided if necessary to provide electrical continuity between the container 12 and the protected structure, which includes support member 11.

Although not contemplated in prior art, including in U.S. Pat. No. 4,549,948, or related U.S. Pat. No. 4,318,787, this device could be used with a variety of thixotropic mixtures comprising particulate anode materials of different electronegativities in order to produce a "potential profile" over time, by, for example, initially pumping a thixotropic mixture with high electronegativity and later in time, after say a dense calcareous layer had developed on the protected structure, changing the thixotropic mixture pumped to a mixture with lower electronegativity.

Similarly, although also not contemplated in the prior art, CP current created by the apparatus taught in U.S. Pat. No. 4,549,948 could be changed by adjusting the surface area of the elongated shape 26, by, for example, changing the flow rate of the thixotropic mixture 29 such that the elongated shape 26 is larger and has more surface area, and consequently induces a higher cathodic current, or is smaller and induces a smaller cathodic current.

In practice, however, this anodic thixotropic mixture system has not proven to be practical; the system is inherently complex and expensive, and offers no particular advantages over an impressed current system. Generally, if it is possible to deploy a conduit 13 from the surface to feed an anodic thixotropic mixture 29 to one or more extrusion dies 24, it will likely be cheaper and more effective to deploy electrical cables as part of an impressed current system.

What is needed are passive marine cathodic protection systems and methods which can employ readily available and inexpensive sacrificial anodes, such as aluminum-zinc-indium alloy anodes, and which allow accurate in situ adjustment of the cathodic potential and/or current density of the system, particularly for equipment and structures which can not economically be protected by an impressed cathodic protection system, such as structures and equipment deployed proximate the seabed.

SUMMARY OF THE DISCLOSURE

In one aspect, embodiments disclosed herein relate to a cathodic protection system for use in an electrolyte, including a protected structure to be at least partially immersed in the electrolyte, at least one sacrificial anode to be at least partially immersed in the electrolyte and electrically connected to the protected structure, and a substantially impermeable barrier disposed between the at least one sacrificial anode and the electrolyte.

In other aspects, embodiments disclosed herein relate to a cathodic protection system for use in an electrolyte, including a protected structure to be at least partially immersed in the electrolyte, at least one sacrificial anode to be at least partially immersed in the electrolyte, at least one secondary cathode to be at least partially immersed in the electrolyte and electrically connected to the at least one sacrificial anode and to the protected structure, and a substantially impermeable barrier disposed between the electrolyte and at least one of the at least one sacrificial anode and the at least one secondary cathode.

In other aspects, embodiments disclosed herein relate to a method to provide cathodic protection to a protected structure, the method including determining a desired cathodic potential on the protected structure, measuring the cathodic potential of the protected structure, and adjusting the cathodic potential of the protected structure by increasing or decreasing an exposed area of at least one of a sacrificial anode and a secondary cathode such that a measured cathodic potential approximates the desired cathodic potential.

Other aspects and advantages of the disclosure will be apparent from the following description and the appended claims.

DETAILED DESCRIPTION

Figure 1:
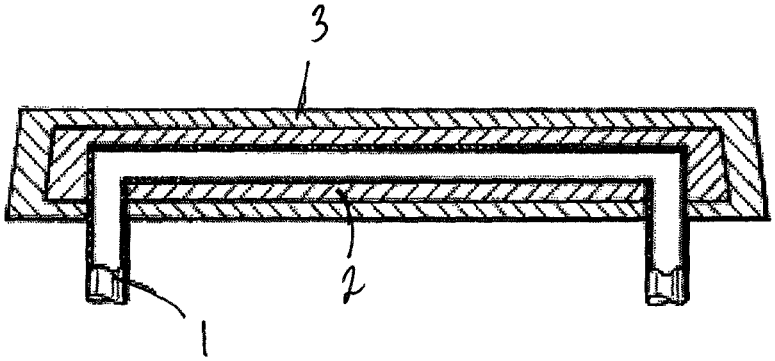
Fig. 1 (Prior Art)
FIG. 1 shows a cross-sectional view of a passive sacrificial anode in accordance with prior art.
Figure 2:
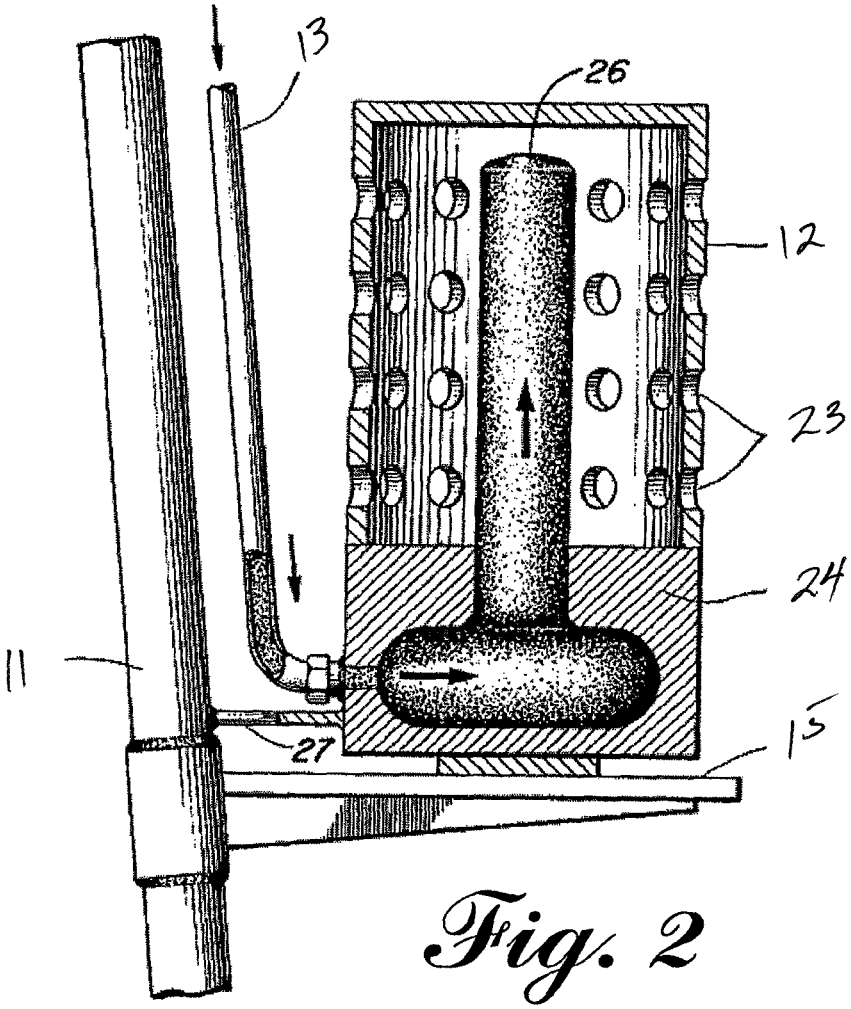
Fig. 2 (Prior Art)
FIG. 2 shows a cross-sectional view of a structure configured to continuously provide sacrificial anode material to a protected structure in accordance with prior art.

In one aspect, embodiments disclosed herein relate to a passive cathodic protection system in which the cathodic potential and/or the cathodic current derived from an installed sacrificial anode may be adjusted in situ.

For purposes of this disclosure, electronegativity is understood to refer to the position of a metal or alloy on the galvanic series in seawater, as shown for example in UK Ministry of Defense Naval Engineering Standard NES 704. Higher electronegativity may be understood to mean a more anodic, more sacrificial, less noble material; magnesium and zinc are examples of materials with high electronegativity. Lower electronegativity may be understood to mean a more cathodic, less sacrificial, more noble material; silver, gold and graphite are examples of materials with low electronegativity.

Embodiments of the present disclosure include at least one marine sacrificial anode with a substantially impermeable barrier between the at least one marine sacrificial anode material and a seawater electrolyte. In further embodiments, the substantially impermeable barrier may be partially or completely removable when the sacrificial anode is in situ, for example, in service on a protected structure proximate the seabed, in order to change the surface area of the at least one sacrificial anode which is exposed to the seawater electrolyte.

In certain embodiments, the sacrificial anode may be made of an aluminum-zinc-indium alloy, available from, for example, Farwest Corrosion Control Company of Gardena California, or the Deepwater Gaus anodes available from Deepwater Corrosion Services of Houston, Tex. In other embodiments, the substantially impermeable barrier may comprise paint or a thermoset resin or a powder-coating material or other polymer film or another substantially impermeable, non-conductive film on the surface of one or more sacrificial anodes, such that the film may be selectively removed from the underlying sacrificial anode by means of a powered brush or similar device, employed, for example, by a diver or by a subsea remotely operated vehicle (ROV).

In further embodiments, the substantially impermeable barrier may be a friable material such as fired vitreous china or other ceramic, which may be effectively removed from the sacrificial anode by a blow from, say, an hydraulically-powered tool carried by an ROV. In still further embodiments, the substantially impermeable barrier may be a remeltable polymer such as, for example, a paraffinic material or a low molecular weight thermoplastic which is applied to a sacrificial anode by dipping the anode into the molten polymer. In a related embodiment, the remeltable polymer may be applied over strings or mesh or similar materials secured to the anode, such that in service the strings may be pulled to remove the hardened remeltable polymer from the anode. In another embodiment, a wax with a high melting point is applied, as by dipping, over a thermoplastic mesh bag secured to the anode. In still another embodiment the mesh bag may be equipped with a ring or lanyard which when pulled, causes the hardened wax to pull away from the anode, thus exposing the surface of the anode.

Figure 3A:
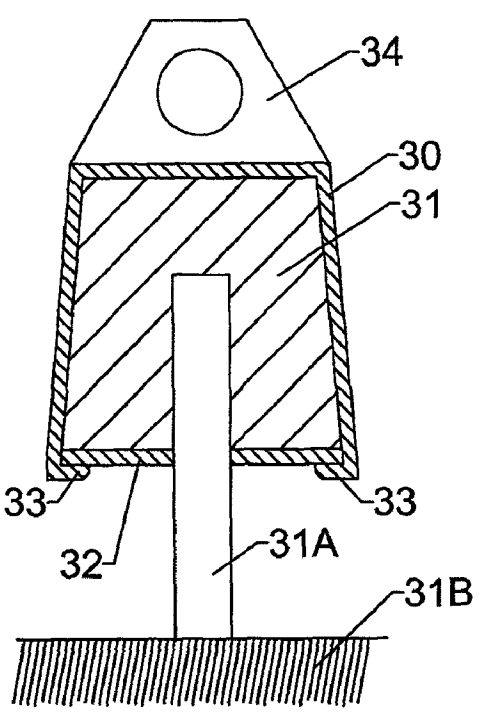
FIGS. 3A-3C show cross-sectional views of a sacrificial anode having varying configurations of protective covers in accordance with embodiments of the present disclosure.

Referring now to FIG. 3A, a cross-section view of a sacrificial anode 31 is shown in accordance with embodiments of the present disclosure. As shown, the sacrificial anode 31 includes a support means 31A (typically a steel rod, pipe or bar) by which it is attached mechanically and electrically to protected structure 31B, as for example, by welding. Anode 31 may be fitted with a substantially impermeable barrier comprising a removable cap 30 secured over sacrificial anode 31 and clipped to a base 32 positioned under the anode 31 with clips 33 attached to the removable cap 30. Removable cap 30 may also comprise an attached ROV handle 34 to facilitate the removal of the cap from the anode by an ROV, and if desired, transport of the cap back to surface.

In certain embodiments, the removable cap 30 may be made of a non-conductive, non-corroding material. In further embodiments, the removable cap 30 and base 32 may be injection molded of a thermoplastic material such as high-density polyethylene (HDPE), and clips 33 and ROV handle 34 are molded integral to removable cap 30. In still further embodiments, removable cap 30 may be fitted with a seal between the edge of cap 30 and base 32 in order to exclude seawater from the surface of the anode material.

As shown in FIG. 3A, a marine structure is equipped with a plurality of the sacrificial anodes with removable caps. A desired cathodic potential proximate the installed sacrificial anodes may be determined by methods known to those of ordinary skill in the art. An ROV equipped with a cathodic potential measuring device, such as the Polatrak® Deep C Meter from Deepwater Corrosion Services in Houston, Tex., may measure the cathodic potential of the marine structure proximate the sacrificial anodes. The ROV may selectively remove or install caps from the sacrificial anodes to adjust the measured cathodic potential to the desired cathodic potential.

Using this method, it may be advantageous to equip the structure with some number of anodes surplus to the expected requirement (which is based on the determination of the desired cathodic potential taken above), to then take a "baseline" potential measurement with the ROV when the structure is first deployed subsea, and then to make small adjustments in the cathodic potential (by covering or uncovering a small number of anodes) on sequential ROV trips. In this and other embodiments, it may also be advantageous to use a plurality of relatively small anodes, such as in the range between 25 and 50 pounds each, up to about 100 pounds, to achieve relatively fine control over the induced cathodic potential.

In another embodiment, base 32 may be made from a substantially non-conductive, non-corroding material such as a thermoplastic, and removable cap 30 may be made from an anode material which is more electronegative than anode 31. Optionally in this embodiment, a conductive material may be placed between anode 31 and removable cap 30 to insure electrical conductivity at minimal resistance between removable cap 30 and protected structure 31B. Conductive materials may include, for example, conductive grease such as Carbon Conductive Grease available from MG Chemicals of British Columbia, Canada, or similar substance, or a highly-conductive, highly noble, metal film, for example gold leaf. In the case of a conductive, highly noble metal film, it may be beneficial to machine mating surfaces on the anode 31 and the removable cap 30 to insure good electrical conductivity through the interspersed conductive metal foil.

In this embodiment, the initial anodic potential of the sacrificial anode may be determined by the electronegativity of the material of removable cap 30, but unlike the composite anode taught in the '948 patent, the cathodic potential may be reduced to that determined by anode 31 by the simple expedient of removing removable cap 30. Alternately, the removable cap 30 and base 32 may both be made from an anodic material, and mechanically joined together by straps or similar devices designed to fail predictably when an ROV pulls on ROV handle 34.

Figure 3B:
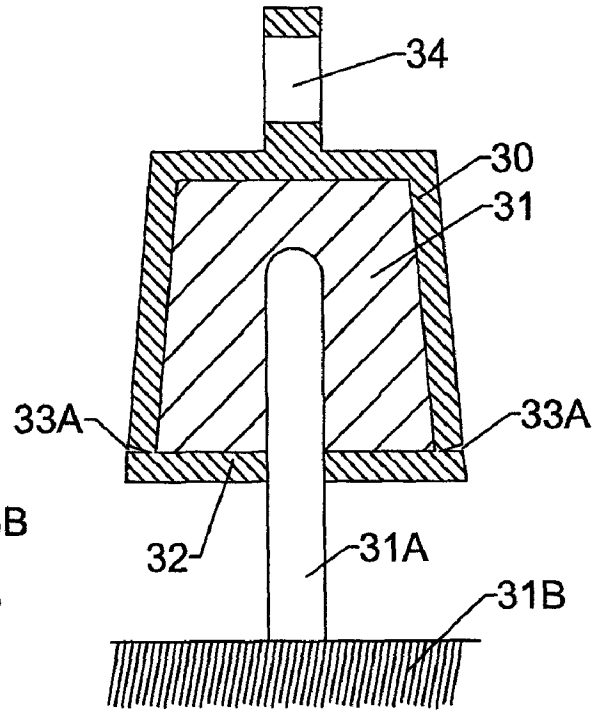

Referring now to FIG. 3B, a cross-section view of a sacrificial anode 31 is shown similar to FIG. 3A, except that removable cap 30 is attached to base 32 at notch 33A in accordance with embodiments of the present disclosure. The reduced cross-sectional area behind notch 33A may be designed to fail predictably when an ROV tool pulls on ROV handle 34. In this embodiment, removable cap 30 and base 32 may be welded together, as by plastic welding, or may be molded in one piece over anode 31. While the anodes 31 shown in FIGS. 3A and 3B are generally trapezoidal in cross-section, those having ordinary skill in the art will recognize that the shape of anode 31 may vary considerably without departing from the teachings of the current disclosure. For example, anode 31 may have a round or rectangular or circular cross-section, or may have a regular or irregular polygonal shape that is not a trapezoid, or may even be substantially spherical.

Figure 3C:
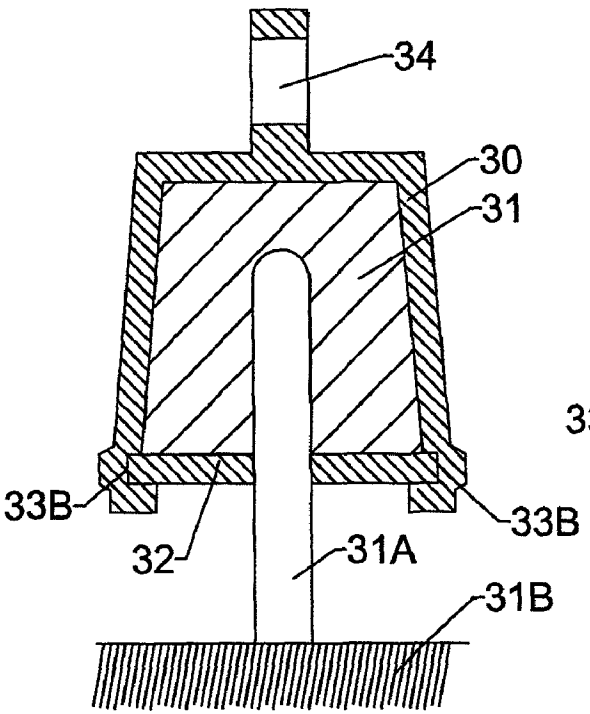

FIG. 3C shows still another cross-section view of a sacrificial anode 31 similar to FIG. 3A, except that removable cap 30 is fitted with a groove 33B such that removable cap 30 is slidably attached to base 32. To adjust the exposed area of anode 31, an ROV may slide removable cap 30 (e.g., in a direction into or out of the plane of the figure) along base 32.

In one embodiment of the present disclosure, a substantially impermeable non-conductive barrier, such as, for example, a hinged clamshell made from HDPE, may be remedially fitted subsea to a pre-existing sacrificial anode in order to, for example, reduce the cathodic potential in an already-installed protected structure. In a related embodiment, a hinged clamshell barrier may be fitted with a foam lining. In another related embodiment, the foam lining may be impregnated with a dielectric fluid or gel to electrically isolate the surface of the anode to which it is applied. In still another related embodiment, a hinged clamshell barrier may have an ROV handle arranged such that the clamshell is normally open, but closes and latches around a previously installed sacrificial anode when urged into position by an ROV.

In one method of embodiments of the present disclosure, the cathodic potential of a previously installed protected structure may be measured, as by an ROV, and remedial substantially impermeable barriers may be fitted to one or more existing sacrificial anodes to reduce the cathodic potential of the protected structure to a desired level. In a related embodiment, the cathodic potential of the protected structure may be adjusted to about −800 millivolt (relative to an Ag/AgCl cell), or to a less negative value.

Figure 3D:
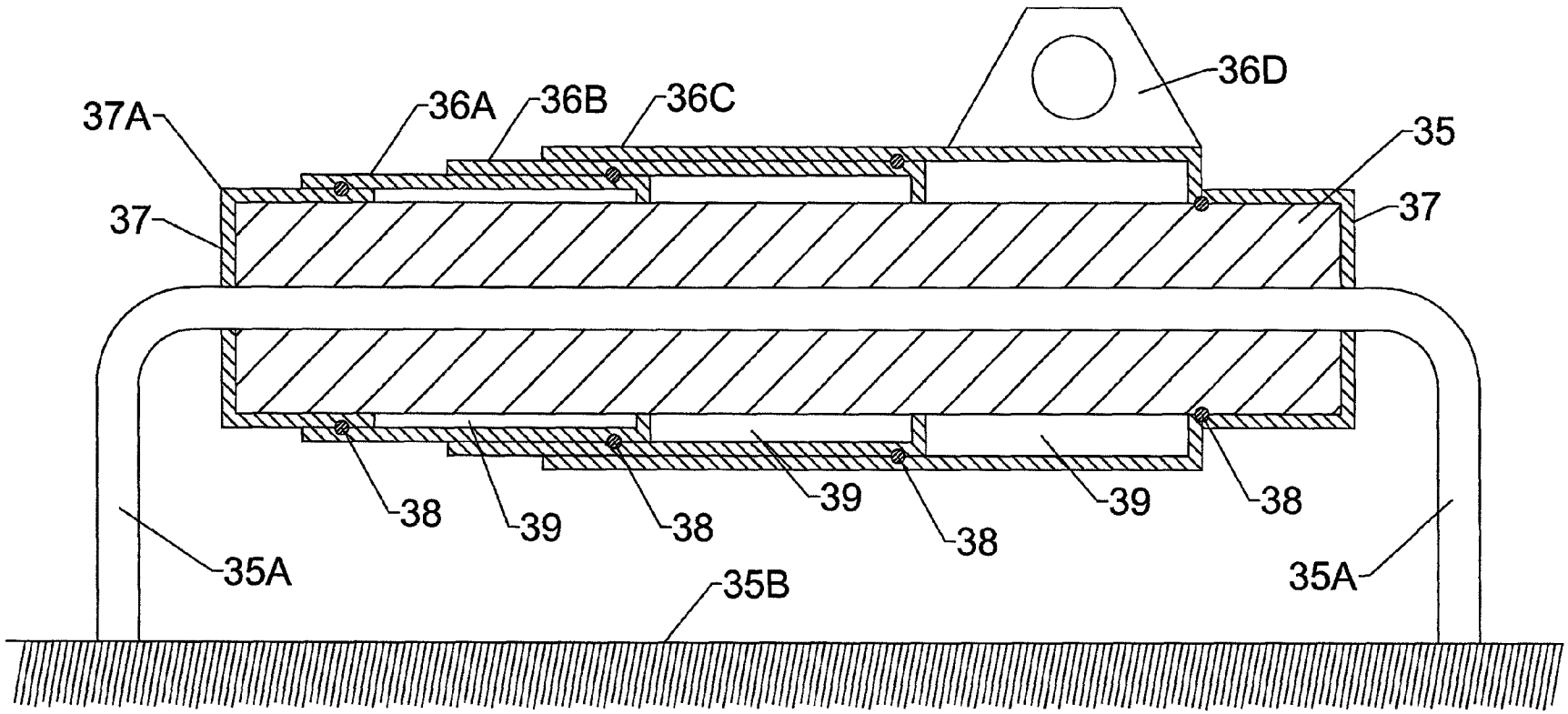
FIG. 3D shows a cross-sectional view of a substantially cylindrical sacrificial anode in accordance with embodiments of the present disclosure.

Referring now to FIG. 3D, a cross-sectional view of a substantially cylindrical sacrificial anode 35 is shown in accordance with embodiments of the present disclosure. The sacrificial anode 35 includes a support means 35A by which it may be attached mechanically and electrically to protected structure 35B. The impermeable barrier comprises concentric telescoping sleeves 36A, 36B, and 36C, and end caps 37, with distal end 37A. Optionally, seals 38 may be fitted to the sleeves in order to reduce communication between the seawater and the annular volume 39 between anode 35 and sleeves 36A, 36B, and 36C. In certain embodiments, sleeves 36A, 36B, and 36C, and end caps 37 are made of an injection molded thermoplastic such as HDPE. In other embodiments, the sleeves may be made of other nonconductive materials such as fiberglass composites, or thermoset polymers such as epoxies or vinyl esters, or engineering thermoplastics such as Delrin® or PEEK.

Those of ordinary skill in the art will recognize that seals 38 may advantageously be relatively "leaky", that is, they may leak seawater at a pressure at or below the collapse pressure of the sleeves, such that the hydrostatic pressure is substantially equalized at depth, but such that the seals still largely restrict movement of seawater in and out of the annular volume 39. Annular volume 39 may be packed at assembly with a tenacious nonconductive paste, such as grease, to shield the covered surface of the sacrificial anode from seawater which may for example leak past seals 38; in some cases, this may also help insure that sleeves 36A, 36B, and 36C can move axially when necessary.

In certain methods of the present disclosure, a marine structure may be equipped with a plurality of the cylindrical sacrificial anodes fitted with cylindrical telescoping sleeves, for example, as shown in FIG. 3D. A desired cathodic potential proximate each of the installed sacrificial anodes is determined, by methods know in the art. An ROV equipped with a cathodic potential measuring device may measure the cathodic potential proximate one of the sacrificial anodes with the protected structure in situ, for example, proximate the seabed. If the measured cathodic potential has a less-negative value than the desired cathodic potential proximate that anode, the ROV may axially slide one or more of the cylindrical sleeves 36A, 36B, and 36C towards distal end 37A, thus exposing some or all of the surface area of the substantially cylindrical sacrificial anode 35 to open seawater. Conversely, if the measured potential is too high, the sleeves may be closed by being moved in the opposite direction.

One or more of cylindrical sleeves 36A, 36B and 36C may be marked on their outer surfaces with axial scales to provide indication of the anode area that has been exposed, and at least one of the cylindrical sleeves may be equipped with an ROV handle 36D (similar to ROV handle 34 in FIG. 3A) to facilitate movement of the sleeves by an ROV. The relationship between the measured cathodic potential and exposed area of the sacrificial anode can be determined for a particular system (that is, a particular protected structure at a particular marine location) with a reasonable amount of experimentation.

Providing a removable, substantially impermeable barrier on at least some of the sacrificial anodes fitted to subsea structures, and relatively precisely adjusting the cathodic potential, has the further potential benefit that anode consumption may be substantially reduced, especially when compared to systems which are "over-protected" (that is, which have cathodic potentials that are unnecessarily too negative). This may have the further benefit of extending the effective life of the installed cathodic protection, particularly in cases where some covered anodes remain "in reserve". It may also have the benefit of allowing an increase in the cathodic potential of a system at some future time in case there is damage to the coatings on the protected structure (including for example an applied paint coating or a calcareous coating), and the protected structure must be "repolarized" at a higher potential than the maintenance potential.

Those of ordinary skill in the art will recognize that other structures may be substituted for the concentric telescoping sleeves shown in FIG. 3D without departing from the teachings of the present disclosure. Other structures may include, but are not limited to, corrugated bellows made from an elastomeric or other polymer material or a substantially cylindrical bag made from a substantially impermeable, non-conductive material, which is sealingly attached at one end to an end cap 37 at distal end 37A and to a sliding ring at the other end.

In one embodiment of the present disclosure, axial zones of a substantially cylindrical sacrificial anode may be covered by a plurality of removable, circumferential, substantially impermeable membranes which may be individually removed, (for example, by starting at one or both ends of the anode and working towards the middle), to expose the underlying anode material to the electrolyte. In a related embodiment, zones of a substantially cylindrical sacrificial anode are covered by a plurality of polymer mesh bands coated with a substantially impermeable polymer, for example wax or a similar substance, wherein each mesh band is fitted with means to allow an individual band and it's polymer coating to be removed by an ROV. In another related embodiment, the sacrificial anode is a standard sacrificial anode of the prior art with a substantially trapezoidal cross-section. In still another embodiment, a standard sacrificial anode of substantially trapezoidal cross-section is uncovered at its ends, but covered by a plurality of coated mesh bands in its mid-section, such that exposed surface area of the sacrificial anode may be relatively finely controlled by the removal of one or more of the mesh bands.

Figure 4:
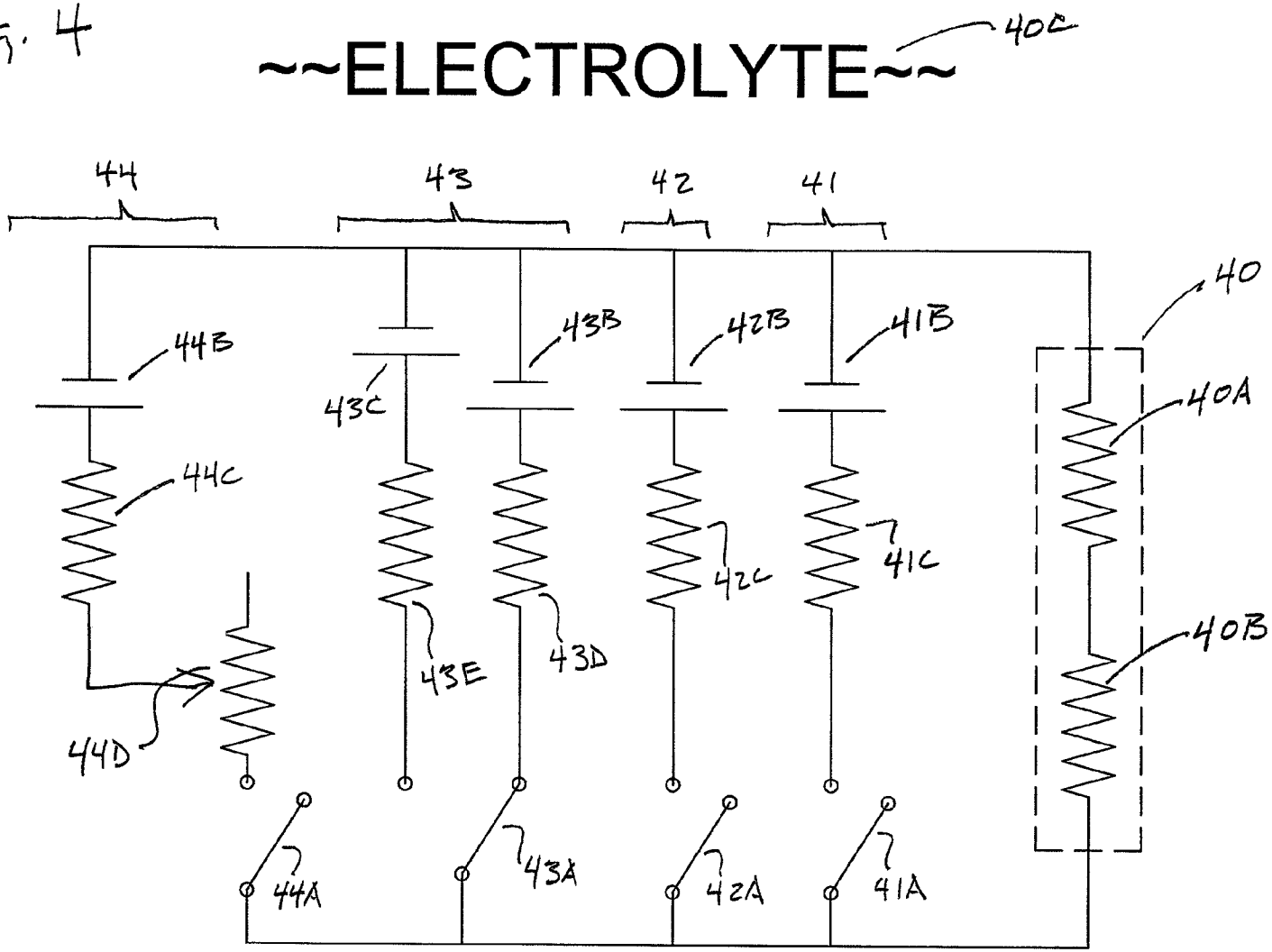
FIG. 4 shows a simplified electrical schematic representative of a marine passive cathodic protection system in accordance with embodiments of the present disclosure.

Referring now to FIG. 4, a simplified electrical schematic representative of a marine passive cathodic protection system is shown in accordance with embodiments of the present disclosure. Protected structure 40, which acts as a cathode, has polarization resistance 40A and cathode-to-electrolyte resistance 40B, and is electrically connected to sacrificial anodes 41, 42, 43, and 44, all of which are immersed in electrolyte 40C (which typically will be seawater, but which also may be brackish or fresh water or other environmental electrolytes, including mud or moist conductive soil). The cathodic protection system of FIG. 4 is not necessarily representative of any practical real-world CP system, but it demonstrates several embodiments of sacrificial anodes of the current disclosure used together in a system. A practical CP system of the current disclosure may, for example, use a large plurality of anodes, and may use anodes of only one or two embodiments of the present disclosure.

Polarization resistance 40A and cathode-to-electrolyte resistance 40B comprise the total resistance that the protected structure presents to the cathodic protection circuit, or, alternately, the "cathodic resistance." Cathode-to-electrolyte resistance 40B represents the cathode-to-electrolyte resistance, part of which may be attributable to coatings on the surface of the protected structure, including but not limited to protective paint or other protective coatings such as powder coatings, or asphaltic coatings, calcareous deposits which may develop as a result of the cathodic protection itself, or marine biological coatings. Cathode-to-electrolyte resistance 40B is sometimes called "solution resistance" or "structure-to-electrolyte resistance" in the prior art.

The polarization resistance 40A represents the inherent resistance of the material of the protected structure to an induced cathodic protection current, regardless of source (that is, whether an active, passive or hybrid cathodic protection system). Polarization resistance may also be called a "charge transfer resistance" or "internal structure resistance" in the prior art. Polarization resistance 40A may be considered an "inherent" resistance of the protected structure to a change in potential, while the cathode-to-electrolyte resistance 40B may be considered the "variable" part of the resistance of the protected structure. For example, cathode-to-electrolyte resistance 40B may be changed by scraping-off some of the paint coating on a protected structure Note that while it is possible to determine separate values for the cathode-to-electrolyte resistance 40A and polarization resistance 40B, by, for example, use of alternating current diagnostic techniques such as electrochemical impedance spectroscopy, knowing these individual resistance values is not required in practice for implementation of the present disclosure. In a purely resistive structure, simple application of Ohm's Law may be used to calculate internal resistance.

Sacrificial anodes 41 and 42 are of a type depicted in FIGS. 3A and 3B, that is, a sacrificial anode of a material known in the prior art (typically an aluminum-zinc-indium alloy) covered with a removable, non-conductive, substantially impermeable barrier such that the anodic surface of the anode is not in contact with the electrolyte unless and until the impermeable barrier is removed. This impermeable barrier may for example comprise base 32 and removable cap 30 as shown in FIG. 3A, made from a non-conductive material such as HDPE. The removable, non-conductive, substantially impermeable barriers are represented electrically by switches 41A and 42A. When the impermeable barriers are removed from sacrificial anodes 41 and 42, switches 41A and 42B are effectively closed and cells 41B and 42B are "activated" by contact between the anodic material and electrolyte 40B. The difference in potential between the sacrificial anodes 41 and 42 and the cathode (structure 40) causes current to flow from the anodes to the cathode.

Sacrificial anodes will have characteristic potentials (typically measured in millivolts) and anode-to-electrolyte resistances (typically measured in ohms) when a known anode is exposed to a known electrolyte at certain conditions (such as temperature, pressure, etc.), that is, an anode's characteristic potential is determined by the anodic material and the electrolyte in which it is immersed. As discussed, characteristic potentials for marine sacrificial anodes are typically referenced to a known galvanic cell such as a silver/silver chloride (Ag/AgCl) cell; commonly used aluminum-zinc-indium anodes may have characteristic potentials of about −1000 to −1050 millivolts relative to an Ag/AgCl cell.

Anode-to-electrolyte resistances for sacrificial anodes attached to a protected structure are typically calculated by an empirically-derived equation known in the art, such as the modified Dwight's equation as follows, for a substantially cylindrical sacrificial anode:

$$R = \frac{P}{2\pi L}\left[\ln\left(\frac{4L}{R}\right) - 1\right]$$

where R represents anode-to-electrolyte resistance, P represents water resistivity in ohm-inches, L represents an exposed anode length in inches, and r represents an effective anode radius in inches.

The anode-to-electrolyte resistances of cells 41B and 42B are represented by resistors 41C and 42C. Following Ohm's Law, the cathodic current induced by a sacrificial anode is the anodic potential divided by the total circuit resistance; in the circuit shown in FIG. 4, the total circuit resistance comprises (a) the anode-to-electrolyte resistance of the exposed anodes (that is, resistances from among 41C, 42C, 43D, 43E, 44C and 44D), plus (b) cathode-to-electrolyte resistance 40B and (c) polarization resistance 40A. Because the anodic potential is determined by the anodic material and the electrolyte in which it is immersed, and the anode-to-electrolyte resistance is a function of exposed anode area (as shown for example in Dwight's Equation, above) it follows that the cathodic current applied to a protected structure may be adjusted by varying the anodic area exposed to the electrolyte.

Sacrificial anode 43 is also of a type shown in FIG. 3A or 3B, except that base 32 may be made from a substantially non-conductive, non-corroding material such as a thermoplastic, and removable cap 30 may be made from an anode material which is more electronegative than anode 31. The initial potential of sacrificial anode 43 may be determined by the electronegativity of the material of the anodic removable cap, but the cathodic potential may be reduced to that determined by the underlying anode by the simple expedient of removing the anodic removable cap. In sacrificial anode 43 in FIG. 4, the (anodic) removable cap is represented electrically by cell 43B, and the underlying anode is represented by cell 43C. Cells 43B and 43C have anode-to-electrolyte resistances 43D and 43E respectively. Initially, with the anodic removable cap in place, switch 43A connects to cell 43B; if the anodic removable cap is removed, thus exposing the underlying anode, this is represented electrically by switch 43A moving to connect cell 43C.

Sacrificial anode 44 is of a type shown in FIG. 3D, with substantially cylindrical sacrificial anode 35, and with a substantial impermeable nonconductive barrier comprising concentric telescoping sleeves 36A, 36B and 36C, end caps 37, and distal end 37A. Seals 38 are fitted to the sleeves in order to reduce communication between the seawater and the annular volume 39 between anode 35 and sleeves 36A, 36B, and 36C.

When the telescoping sleeves of sacrificial anode are completely closed, and there is substantially no communication between the electrolyte and the anode surface of sacrificial anode 44; this is represented electrically by switch 44A being in the disconnected position. If the telescoping sleeves are then opened slightly to allow electrolyte 40B to contact a small area of anode material, that would be represented electrically by closing switch 44A.

Cylindrical sacrificial anode 35 in FIG. 3D is represented in FIG. 4 by cell 44B, which has inherent anode-to-electrolyte resistance 44C, representative of the anode-to-electrolyte resistance of the anode when it is fully exposed to the electrolyte. Variations in the anode-to-electrolyte resistance due to changes in the exposed area of the anode from movement of the telescoping sleeves are represented electrically by adjustment of potentiometer (or rheostat) 44D. Referring to Dwight's Equation, the resistance of potentiometer 44D will be at a maximum when a minimum anode area is exposed and at zero ohms when the full area of anode 35 is exposed.

Figure 5C:
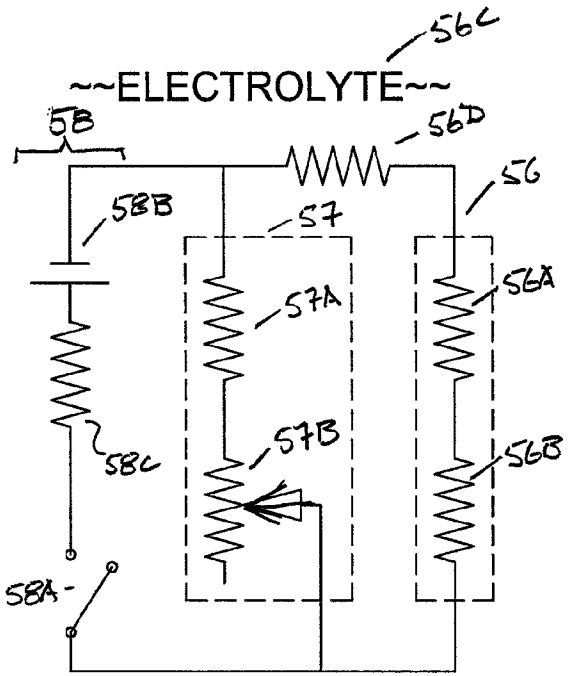
FIGS. 5A-5C show simplified electrical schematics representative of cathodic protection systems that include at least one sacrificial anode, at least one protected structure, and at least one secondary cathode in accordance with embodiments of the present disclosure.
Figure 5B:
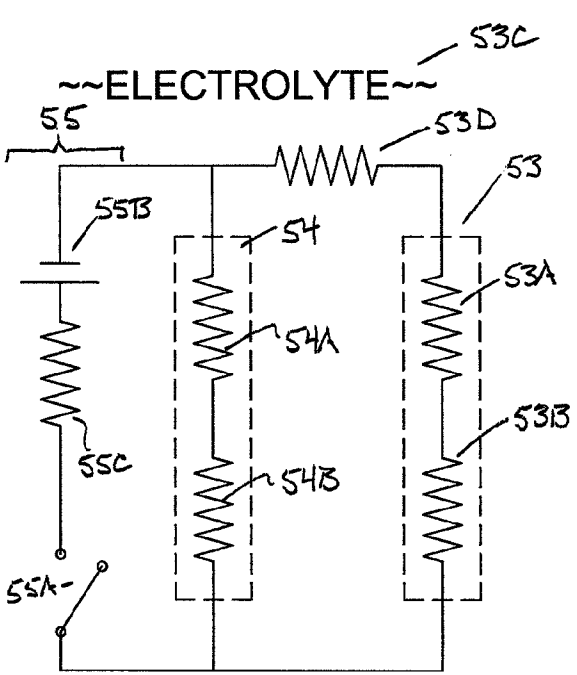
Figure 5A:
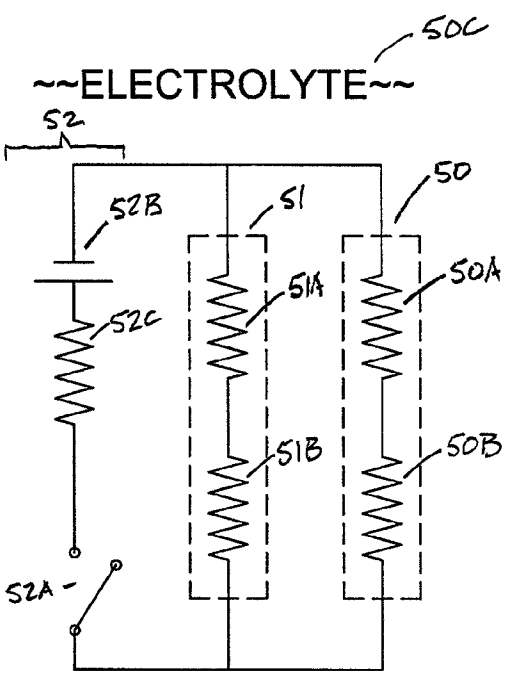

Referring now to FIGS. 5A, 5B, and 5C, simplified electrical schematics representative of cathodic protection systems that include at least one sacrificial anode, at least one protected structure, and at least one secondary cathode are shown in accordance with embodiments of the present disclosure. These embodiments may allow for the adjustment of both exposed anode area and exposed cathode area. Additionally, these embodiments may have particular utility for subsea structures such as subsea BOP stacks, production valve assemblies (e.g., "Christmas trees"), production templates and manifolds, subsea pumps, and other subsea devices which may comprise a mild steel frame and high strength steel components. In this case, the protected structure of the embodiments shown in FIGS. 5A-5C may include the high strength steel components and the secondary cathode may comprise the mild steel framework.

Further, in these embodiments, the protected structure may be painted or otherwise coated with a protective film, while the secondary cathode may be either thinly painted or unpainted. In one embodiment of the current disclosure, a marine cathodic protection system comprises at least one sacrificial anode, at least one protected structure, and at least one secondary cathode, in which the cathodic resistance of the at least one protected structure is greater than the cathodic resistance of the secondary cathode.

Those having ordinary skill in the art will recognize that the sacrificial anodes represented in FIGS. 5A-5C may be, instead of the type shown in the figures, any of the types of sacrificial anodes taught in the embodiments disclosed herein, or even a conventional sacrificial anode, or a plurality of any one anode type, or a mixture of anode types, without departing from the teachings of the current disclosure.

In the embodiment shown in FIG. 5A, protected structure 50 has polarization resistance 50A, cathode-to-electrolyte resistance 50B, and is electrically connected to secondary cathode 51 and sacrificial anode 52, all of which are immersed in electrolyte 50C. Secondary cathode 51 has polarization resistance 51A and cathode-to-electrolyte resistance 51B; the base material of secondary cathode 51 has an electronegativity that is equal to or slightly greater than the electronegativity of the material of protected structure 50, but less than the electronegativity of the active material of sacrificial anode 52.

Sacrificial anode 52 is shown as an anode taught in FIG. 3A of the present disclosure, including substantially impermeable barrier 52A (represented electrically as a switch), cell 52B and anode-to-electrolyte resistance 52C. In one related embodiment, sacrificial anode 52 may be replaced by a plurality of anodes as taught in FIG. 3A. In other embodiments, sacrificial anode 52 may be replaced by a plurality of anodes of different types taught in the current disclosure. In still further embodiments, sacrificial anode 52 may be replaced by one or more sacrificial anodes of at least one type taught in the current disclosure, and one or more conventional sacrificial anodes of the prior art.

In one embodiment of the present disclosure, and as shown in FIG. 5A, the cathodic resistance of protected structure 50 (that is, polarization resistance 50A, plus cathode-to-electrolyte resistance 50B) is greater than the total resistance of secondary cathode 51 (that is, polarization resistance 51A plus cathode-to-electrolyte 51B). For example, protected structure 50 may include a subsea valve manifold that is painted with catalyzed epoxy paint, and secondary cathode 51 may include an unpainted mild steel framework on which both protected structure 50 and sacrificial anode 52 are mounted.

FIG. 5B shows a cathodic protection system of the present disclosure similar to the system shown in FIG. 5A, including protected structure 53, secondary cathode 54, and sacrificial anode 55, all immersed in electrolyte 53C. Protected structure 53 has polarization resistance 53A and cathode-to-electrolyte resistance 53B. Secondary cathode 54 has polarization resistance 54A and cathode-to-electrolyte resistance 54B. Sacrificial anode 55 has removable substantially impermeable barrier 55A, anode-to-electrolyte resistance 55C, and cell 55B. In this embodiment, however, sacrificial anode 55 may be electrically connected directly to secondary cathode 54, but both are electrically connected to protected structure 53 by cathode resistor 53D. Cathode resistor 53D may comprise any type of resistor known in the prior art, provided that it can accommodate the cathodic current and voltage in the circuit, and withstand subsea operating conditions; cathode resistor 53D may preferentially be an encapsulated carbon composition or wirewound resistor. In one related embodiment, cathode resistor 53D may include epoxy-encapsulated carbon composition pucks used to support and electrically isolate protected structure 53 within a mild steel framework comprising secondary cathode 54.

Those having ordinary skill in the art will recognize that cathode resistor 53D may serve the function of dropping the cathodic potential within protected structure 53, while preserving a relatively high cathodic potential within secondary cathode 54. This may have important utility for subsea devices such as oil and gas production manifolds which may have a relatively small protected structure 53 made from high-strength steel (such as, for example, high pressure valves), but a relatively large secondary cathode 54, such as one, for example, comprising a large mild steel "cap" structure designed to protect against fouling of fishing trawls or the like.

FIG. 5C shows a cathodic protection system of the present disclosure similar to the system shown in FIG. 5B, comprising protected structure 56, secondary cathode 57, and sacrificial anode 58, all immersed in electrolyte 56C. Protected structure 53 has polarization resistance 56A and cathode-to-electrolyte resistance 56B. Secondary cathode 57 has polarization resistance 57A and cathode-to-electrolyte resistance 57B. Sacrificial anode 58 has removable substantially impermeable barrier 58A, anode-to-electrolyte resistance 58C, and cell 58B. Protected structure 56 is electrically connected to secondary cathode 57 and sacrificial anode 58 by cathode resistor 56D.

In this embodiment, however, cathode-to-electrolyte resistance 57B of secondary cathode 57 is variable, and is represented electrically by a potentiometer. In practice, variable cathode-to-electrolyte resistance may be accomplished by a movable, substantially impermeable sleeve, such as the one taught in the sacrificial anode shown in FIG. 3C, fitted over a member of secondary cathode 57. For example, secondary cathode 57 may include a structural steel framework such as a subsea BOP frame, wherein one or more unpainted members of the framework are fitted with movable, substantially impermeable sleeves to control contact between the secondary cathode and the electrolyte. In one embodiment of the system shown in FIG. 5C, secondary cathode 57 may include at least one unpainted mild steel cylindrical member at least partially isolated from electrolyte 56C by at least one sliding substantially impermeable members including, for example, HDPE sleeves, and in which cathode-to-electrolyte resistance 57C may be adjustable by displacing a substantially impermeable sleeve to expose more or less of the mild steel members to the electrolyte. In a certain embodiments of the present disclosure, the secondary cathode may include a plurality of steel members, each of which is isolated from the electrolyte by a removable, substantially impermeable membrane, such that area of the secondary cathode exposed to the electrolyte my be adjusted by selectively removing one or more substantially impermeable membranes from the steel members of the secondary cathode. In a related embodiment, ROV-removable mesh bands may be secured to the secondary cathode, and a polymer coating, such as a wax, may be applied over the mesh bands, for example by spraying the wax. Those of ordinary skill in the art will recognize that the exposed area of a secondary cathode may be controlled by any means taught in the current disclosure for a sacrificial anode, and vice-versa.

Note that while the protected structures and secondary anodes shown in FIGS. 5A, 5B, and 5C are electrically connected in parallel, in another embodiment of the current disclosure they may be connected in series, as for example if the secondary anode comprises a mild steel pipeline connected to a protected structure which comprises a valve manifold, and the sacrificial anode is electrically connected to the distal end of the pipe away from the protected structure.

Advantageously, embodiments of the present disclosure provide a passive marine cathodic protection system that employs readily available and inexpensive sacrificial anodes, thus reducing costs. In addition, embodiments disclosed herein allow accurate in situ adjustments of the cathodic potential and/or current density of the system, particularly for equipment and structures that may not economically be protected by an impressed cathodic protection system, such as structures and equipment deployed near the sea floor.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A cathodic protection system for use in an electrolyte, comprising:

a protected structure to be at least partially immersed in the electrolyte;

at least one sacrificial anode to be at least partially immersed in the electrolyte and electrically connected to the protected structure, and a substantially impermeable barrier disposed between the at least one sacrificial anode and the electrolyte.

2. The cathodic protection system of claim 1, wherein the substantially impermeable barrier is removable.

3. The cathodic protection system of claim 2, wherein the removable substantially impermeable barrier is removable by a remotely operated vehicle.

4. The cathodic protection system of claim 1, wherein the substantially impermeable barrier is adjustable to vary an amount of a surface area of the at least one sacrificial anode exposed to the electrolyte.

5. The cathodic protection system of claim 4, wherein the adjustable substantially impermeable barrier is adjustable by a remotely operated vehicle.

6. The cathodic protection system of claim 1, further comprising passive cathodic protection.

7. The cathodic protection system of claim 1, further comprising active cathodic protection.

8. The cathodic protection system of claim 1, further comprising hybrid cathodic protection.

9. The cathodic protection system of claim 1, wherein the electrolyte comprises sea water.

10. The cathodic protection system of claim 1, wherein the substantially impermeable barrier comprises a polymer.

11. The cathodic protection system of claim 10, wherein the substantially impermeable polymer barrier comprises polyethylene.

12. A cathodic protection system for use in an electrolyte, comprising:

a protected structure to be at least partially immersed in the electrolyte;

at least one sacrificial anode to be at least partially immersed in the electrolyte;

at least one secondary cathode to be at least partially immersed in the electrolyte and electrically connected to the at least one sacrificial anode and to the protected structure; and a substantially impermeable barrier disposed between the electrolyte and at least one of the at least one sacrificial anode and the at least one secondary cathode.

13. The cathodic protection system of claim 12, wherein the material of the at least one secondary cathode has an electronegativity greater than or equal to the electronegativity of the material of the protected structure.

14. The cathodic protection system of claim 12, wherein the secondary cathode has a lower cathodic resistance than the protected structure.

15. A method to provide cathodic protection to a protected structure, the method comprising:

determining a desired cathodic potential on the protected structure;

measuring the cathodic potential of the protected structure; and adjusting the cathodic potential of the protected structure by increasing or decreasing an exposed area of at least one of a sacrificial anode and a secondary cathode such that a measured cathodic potential approximates the desired cathodic potential.

16. The method of claim 15, further comprising adjusting the cathodic potential of the protected structure with a remotely operated vehicle.

17. The method of claim 15, further comprising providing a material of the secondary cathode having an electronegativity greater than or equal to the electronegativity of a material of the protected structure.

18. The method of claim 15, further comprising providing a material of the secondary cathode having a lower cathodic resistance than a material of the protected structure.

* * * * *